United States Patent [19]

Reed

[11] Patent Number: 4,874,333

[45] Date of Patent: Oct. 17, 1989

[54] SHUNTED MODULAR ELECTRICAL CONNECTOR

[75] Inventor: Carl G. Reed, Clemmons, N.C.

[73] Assignee: AMP Incorporated, Harrisburg, Pa.

[21] Appl. No.: 709,961

[22] Filed: Mar. 8, 1985

[51] Int. Cl.[4] ..... H01R 13/00

[52] U.S. Cl. ..... 439/514

[58] Field of Search ..... 339/222, 19, 42, 176 R, 339/176 M, 186 R, 180 M, 17 R

[56] References Cited

U.S. PATENT DOCUMENTS

| | | | |
|---|---|---|---|
| 3,390,385 | 9/1975 | Moyer et al. | 339/19 |
| 4,070,557 | 1/1978 | Ostapovitch | 339/19 |
| 4,179,173 | 12/1979 | Rise, III | 339/19 |
| 4,274,691 | 6/1981 | Abernethy et al. | 339/222 |
| 4,460,234 | 7/1984 | Bogese | 339/222 |

*Primary Examiner*—Joseph H. McGlynn
*Attorney, Agent, or Firm*—Robert W. Pitts

[57] ABSTRACT

A connector assembly comprising a modular jack receiving a modular plug for interconnecting multiple contact elements in contact terminals located laterally in a row is disclosed. Nonadjacent contact elements in one of the connectors can be shunted by at least one separate shunting element. Interengagement of the two connectors can shift the shunting element to disconnect the bridged contact elements. The shunting elements are positioned such that a mating connector having a width no greater than the spacing of the shunting elements will not disengage the bridged connection.

12 Claims, 5 Drawing Sheets

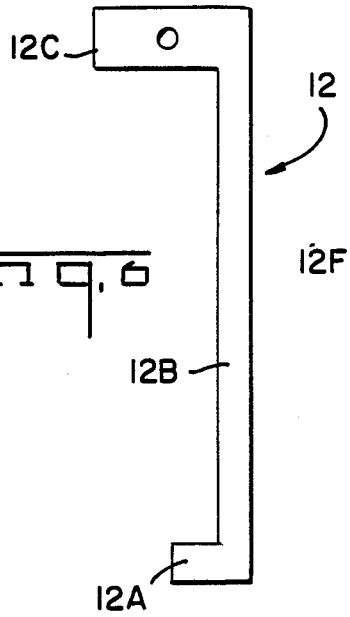
Fig. 6
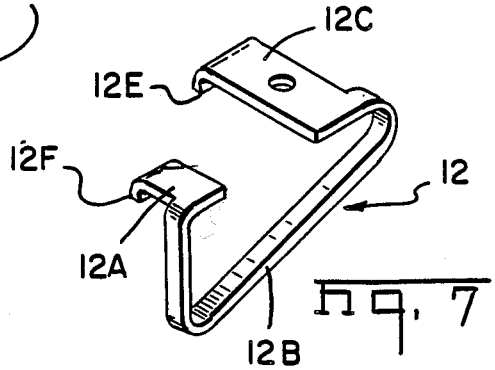
Fig. 7
Fig. 8
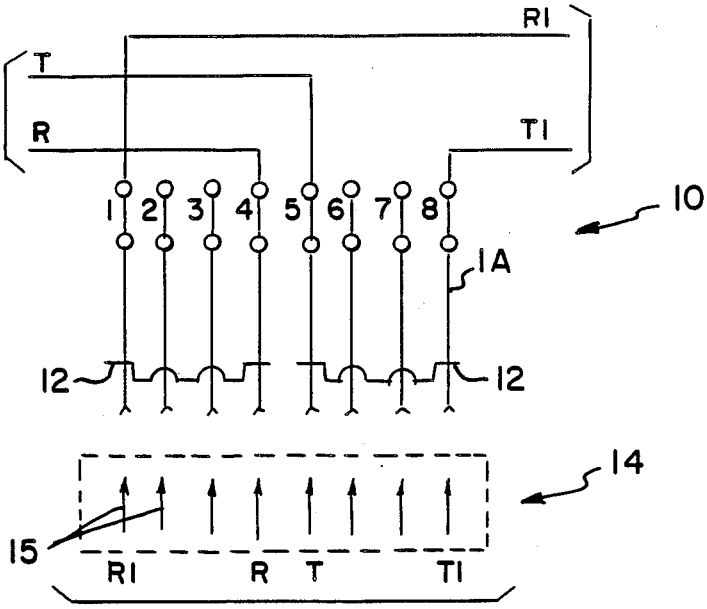

SHUNTED MODULAR ELECTRICAL CONNECTOR

BACKGROUND OF THE INVENTION

1. Field of the Invention

This invention relates to multi-contact electrical connectors used for interconnecting and disconnecting conductors in which two or more of the connectors can be selectively shunted, and more particularly to modular connectors used to interconnect and disconnect equipment to a telephone network.

2. Description of the Prior Art

Multi-contact modular conductors consisting of standard plugs and jacks are commonly used to connect telephones, data processing equipment, and similar equipment to a switched telephone network. One type of connector used for this purpose consists of a four, six or eight position connector assembly including a jack which would normally mate with a mating plug attached to the equipment to be added to the telephone network. One such electrical connector receptacle or jack is disclosed in U.S. Pat. No. 4,193,654. That Electrical jack consists of a housing, having a longitudinally extending cavity profile to receive a companion plug. A plurality of contact elements or terminals are positioned in the jack housing with deflectable cantilever portions extending into the cavity. The remaining portion of the contact elements or terminals are secured to the exterior of the housing and are formed for receipt into a printed circuit board at the opposite end of the contact elements from the cantilever portions located within the housing. Receptacles or jacks of this type can be constructed to receive any number of contact elements and are conventionally constructed with four, six or eight contact elements. These conventional receptacles have a keying profile for keying the plug relative to the jack so that the contact terminals and the plug will be in alignment with the contact elements in the jack or receptacle. Thus it is possible to insert a plug having six terminals into a housing having eight contact terminals. Conventional receptacles and jacks of this type are constructed with terminals and contact elements on center lines such that a six position plug will be appropriately keyed to engage the six innermost contact elements on an eight position jack.

Defensive publication T961,003 discloses a female connector or jack having a row of side-by-side contact springs. These contact springs can be positioned in a conventional eight position jack to make contact with a four, six or eight contact plug. Additional switch contact springs are positioned adjacent the two ends of the row of contact elements. Each pair of additional springs on each end includes a movable contact spring and a stationary contact spring in engagement with the movable contact spring. Insertion of a plug having a width greater than the extent of the eight innermost principal contact elements will deflect the movable contact spring thus opening the switches on either end. The switch springs positioned at either end of the row of contact elements are connected by wires to common terminals to bridge selected contact elements. For example, one switch can bridge the terminals in the first and fourth position of an eight contact row. By attaching wires from the stationary contact spring and the first contact element to a termination and by securing wires extending from the movable contact spring and from the fourth position to a separate termination, the first and fourth contact elements will be bridged so long as the two switch contacts remain in contact. U.S. Pat. No. 4274691 discloses a modular jack assembly having contact elements extending diagonally into a plug receiving cavity of a modular jack. The contact springs are pivoted about the front end of the cavity which receives a companion plug. Shorting elements extend through the housing and are positioned at the rear of the plug receiving cavity. The spring contact elements are normally resiliently flexed to engage the shorting elements until a plug is inserted into the cavity to deflect the contact elements away from the rearwardly exposed shorting elements.

Specifications intended to insure compatibility of equipment incorporated into a switched telephone network require that eight position jacks used in certain systems have the capability of bridging two or more of the individual contact elements. For example, in certain situations an eight position jack must maintain a series connection to tip and ring conductors of a telephone line. If additional jacks are to be positioned in series with this jack, it is necessary that these tip and ring conductors be bridged through each jack in order for equipment inserted into any one of these jacks to properly function when the other jacks remain vacant. For example, some applications require that conductors in the first and fourth positions be bridged to maintain series continuity for the ring conductor through the unoccupied telephone jack and that contact elements in the fifth and eighth positions be bridged to maintain series continuity for the tip conductors through the unoccupied telephone jack.

If a six position plug were to be inserted in this eight contact jack, series continuity to the other telephone equipment or other telephone jacks could only be maintained if the bridged contact elements remain shorted. If an eight position plug were inserted into the jack, the bridged contact elements must no longer be bridged since it is necessary to establish a series connection for both the ring tip conductors through the equipment connected to the jack by its attached eight position plug. At present no known jack otherwise having the configuration of a standard eight position jack possesses this capability. The jack depicted in U.S. Defensive Publication T961,003 establishes such disconnectable bridge connection by adding additional contact elements in the form of spring contacts which must in turn attached to appropriately positioned contact elements by external wires. Furthermore, none of the prior devices provides a shunted modular connector according to the type represented by the preferred embodiment disclosed herein, in which the contact elements in the modular connector are attachable at discrete points to an external path. For example, none of the prior devices is adaptable to be attached to discrete paths on a printed circuit board while retaining the capability of establishing a bridged connection, when a plug having a width less than the lateral extent of the row of contact elements is inserted into the receptacle; while disrupting the bridge connection when a plug having a width greater than the lateral extent of the contact element row is received within a plug receiving cavity of the receptacle or jack.

SUMMARY OF THE INVENTION

An electrical connector, such as a modular jack depicted in the preferred embodiment of this invention is intended for use in interconnecting and disconnecting a plurality of separate conductors in a network upon insertion of a mating electrical connector, such as a plug, corresponding to a jack into a cavity extending into the first connector housing. A plurality of contact elements each have first portions, such as deflectable cantilever portions of the terminals used in the preferred embodiment of this invention, extending into the cavity defined by the housing. In the preferred embodiment, each of the contact elements extends diagonally in the housing. The contact elements are each attached to the housing and provide leads for attachment to the external circuitry. At least one shunting element can be positioned at one side edge of the housing cavity to bridge two or more of the contact elements. Insertion of a plug into the housing cavity imparts relative deflection between the contact portions of the shunting element and the bridged contact elements. In one embodiment of this invention the shunting element has an intermediate portion extending longitudinally relative to each longitudinally extending contact element. Laterally extending contact portions are located on either end of the shunting element intermediate portion to establish contact with only those contact elements to be bridged. The intermediate portion of the shunting element may be positioned at the outermost lateral extent of the housing cavity such that only a plug having a width greater than the lateral extent of the contact elements will be effective to engage a shunting element to impart relative movement between the shunting element and the bridged contact elements at the point of contact therebetween.

BRIEF DESCRIPTION OF THE DRAWINGS

FIG. 6 is a view of the stamped blank used to form the shunting element.

FIG. 7 is a view of the formed shunting element as it would be received within the housing of the jack.

FIG. 8 is a circuit diagram showing a series connection between bridged contact elements which could be facilitated by use of the modular jack corresponding to the preferred embodiment of this invention.

DETAILED DESCRIPTION OF THE PREFERRED EMBODIMENT

Figure 1:
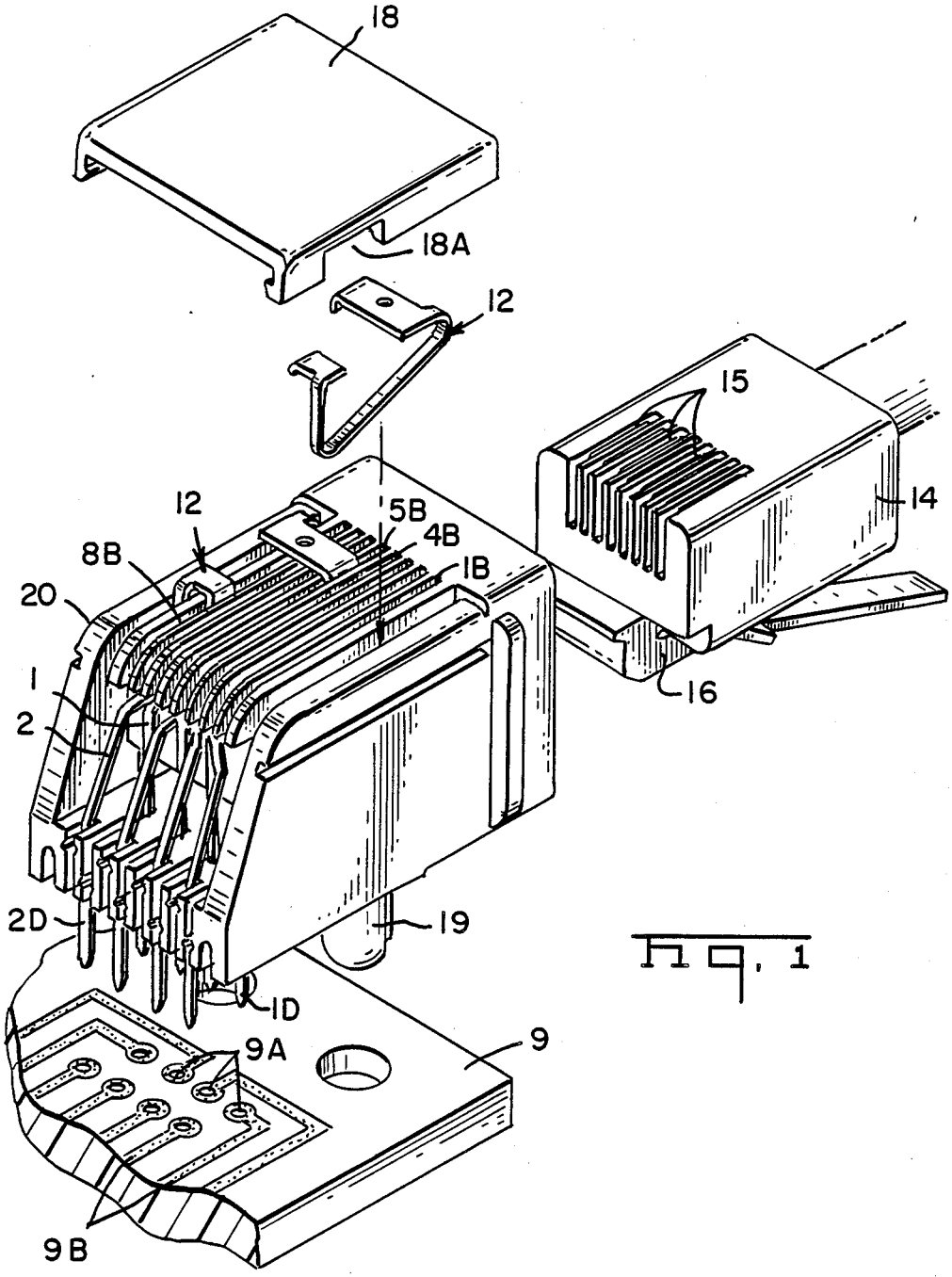
FIG. 1 is an exploded perspective view of the modular connector showing contact elements which can be attached to a printed circuit board and a companion plug.
Figure 2:
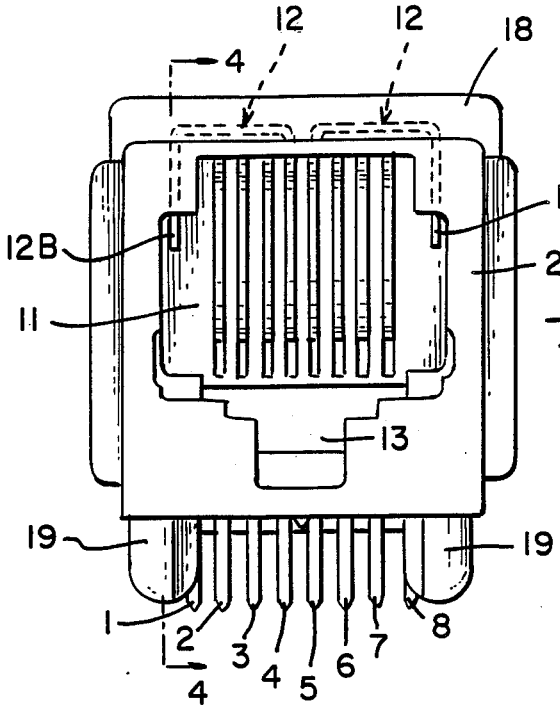
FIG. 2 is a front plan view showing laterally extending shunting elements in engagement with contact elements located intermediate the ends of a multi-contact row.

The shunted modular electrical connector 10 comprises a receptacle or jack including a plurality of contact terminals 1 thru 8 positioning in a insulative housing 20. The housing 20 has an inwardly longitudinally extending cavity 11 defined therein. Cavity 11 is adapted to receive a mating modular plug which can be attached by means of a multi-conductor cable to equipment which is to be interconnected to a network, such as a switched telephone network. Indeed the modular jack 10 and modular plug 14 depicted in FIG. 1 comprise standard modular telephone jacks and modular telephone plugs intended primarily for use in a switched telephone network.

A longitudinally extending groove 13 defining a keying jack profile communicates with the plug receiving cavity 11 at its lower end. In the preferred embodiment of this invention, the keying groove 13 is generally rectilinear profile and is adapted to mate with a key profile 16 on the standard jack 14. The keying profile 13 is located in the center of the front face of modular jack 10 and is adapting to align contact terminals 15 and the modular plug 14 with corresponding contact elements 1 thru 8 ;in the modular plug 10. Receipt of keyed profile 16 of the plug 14 in the keying profile groove 13 will serve to align a four, six or eight position plug with the innermost four, innermost six or the eight contact elements in modular jack 10. When a sixth position plug is inserted into an eighth position jack and six contact terminals 15 and plug 14 will be aligned with the six innermost contact elements 2 thru 7 in an eight position jack as shown.

The eight contact elements 1 thru 8 are insertable into position in the insulating housing 20 essentially in the manner described in U.S. Pat. No. 4,193,654. Each contact element preferably stamped and formed from a resilient metal. Each contact element can also be plated either in selective areas or over its entire surface to insure contact integrity when electrical contacts are to be made. It should, of course, be understood that this invention is in no way limited to the use of stamped and formed contacts as in the preferred embodiment of the invention. This invention would also be suitable for use with individual contact elements formed from round wire.

Each of the integral contact elements has separate portions defined therein. Referring to contact element 1, one end comprises a cantilever portion 1A extending diagonally through the plug receiving cavity 11. These resilient cantilever portions 1A are formed by bending the contact element to separate the deflectable cantilever portion 1A from a portion 1B which is held fixed to the top of the housing 20. An adjacent section 1C of each contact element is held fixed relative to the rear of the insulated housing. Suitable means, such as stake sections of contact element portions 1B and 1C may be used to engage the exterior of the housings to maintain contact element fixed relative to the housing exterior of the plug receiving cavity 11. For example, means such as that shown in U.S. Pat. No. 4,193,654 can be defined in contact element portions 1B and 1C to fix these portions by engagement with the channels 10C in the manner shown in U.S. Pat. No. 4,193,654. Contact elements sections 1B and 1C thus remain stationary relative to the housing 20. Cantilever section 1A is, however, totally deflectable relative to the housing 20 and relative to the stationary fixed contact element portions 1B and 1C. It should be apparent that cantilever section 1A can be pivoted about the end in each contact element adjacent fixed section 1B toward the front of the plug receiving cavity 11.

Lead portions 1D adjacent the fixed section 1C are defined at the end of the contact elements opposite from the resilient cantilever portions. These lead portions 1D are suitable for receipt within holes 9A defined in a printed circuit board. These holes secure the leads 1B in contact with printed circuit board traces 9B. In order to insure optimum spacing of the printed circuit board traces, adjacent contact elements, such as elements 1 and 2 can have staggered rear portions 1C and 2C to facilitate closer spacing of printed circuit board traces printed circuit board holes 9A. In addition to securing the leads 1D, 2D, etc. to the printed circuit board an integral foot 19 on the housing can be provided for engagement with a cooperating hole on the printed circuit board to firmly affix the modular jack to a printed circuit board.

The discrete electrical contact elements 1 thru 8 can thus be disposed within the housing 20 and positioned in contact with external conductors or discrete paths forming a part of a network such as a telephone network. Signals are discretely transmittable through positions 1 thru 8. In some applications however, it is necessary that certain contact elements be shorted or bridged. For example, a common requirement evidenced by the circuit diagram of FIG. 8 requires that the contact element in position 1 be bridged with the contact element in position 4 while the contact element in position 5 must be bridged with the contact element in position 8. As shown in FIG. 8 this bridge connection maintains a series connection for tip conductors through the modular jack as well as a series connection for ring conductors through the modular jack, when no plug is positioned within plug receiving cavity 11.

Figure 3:
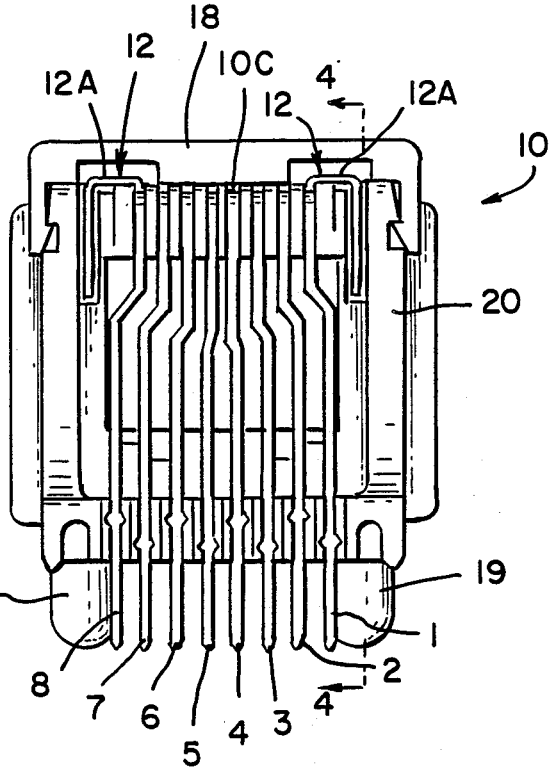
FIG. 3 is a rear plan view similar to FIG. 2, longitudinally displaced therefrom and showing contact between a shunting element and other contact elements.

Shunting elements 12, which can be positioned adjacent the outermost contact elements 1 and 8 and adjacent the longitudinally extending side of the plug receiving cavity 11, are employed herein to shunt selected bridged contact elements. In the preferred embodiment of this invention each of the shunting elements 12 comprises a stamped and formed element formed from a blank such as that shown in FIG. 6 although an element having a circular cross-section could be employed. Each element comprises a first laterally extending portion 12A at one end of an intermediate portion 12B. An opposite or second contact portion 12C is located at the other end of the intermediate section 12B. The shunting element 12 is formed into curvilinear configurations such as shown in FIG. 7. The shunting element 12 is disposed in the housing 20 with the intermediate section 12B extending longitudinally and diagonally into the plug receiving cavity 11. The laterally extending contact portion 12C has a lip 12E formed on its outermost edge thereof and extends above the fixed portions 1B of one or more contact elements in the modular jack. In the preferred embodiment of this invention a shunting element 12 has a laterally extending portion 12C which extends over fixed portions of contact elements 1, 2 and 3 and makes contact with a fixed portion at the upper end of the contact element in the fourth position. Clearance is provided by the downwardly formed lip 12E which engages the contact element in the fourth position, but the remainder of the laterally extended portion 12C is spaced from the intermediate contacts. The other laterally extending portion 12A of each contact element also has a downwardly deflected lip 12F at its outermost edge. As shown in FIG. 3 the lateral extending portion 12A engages the outermost contact element. Thus the shunting element 12 located on the left of the housing engages contact element 1 while the separate shunting element on the right of the cavity 11 as shown in FIG. 3 engages the contact element in the eighth position.

Figure 4:
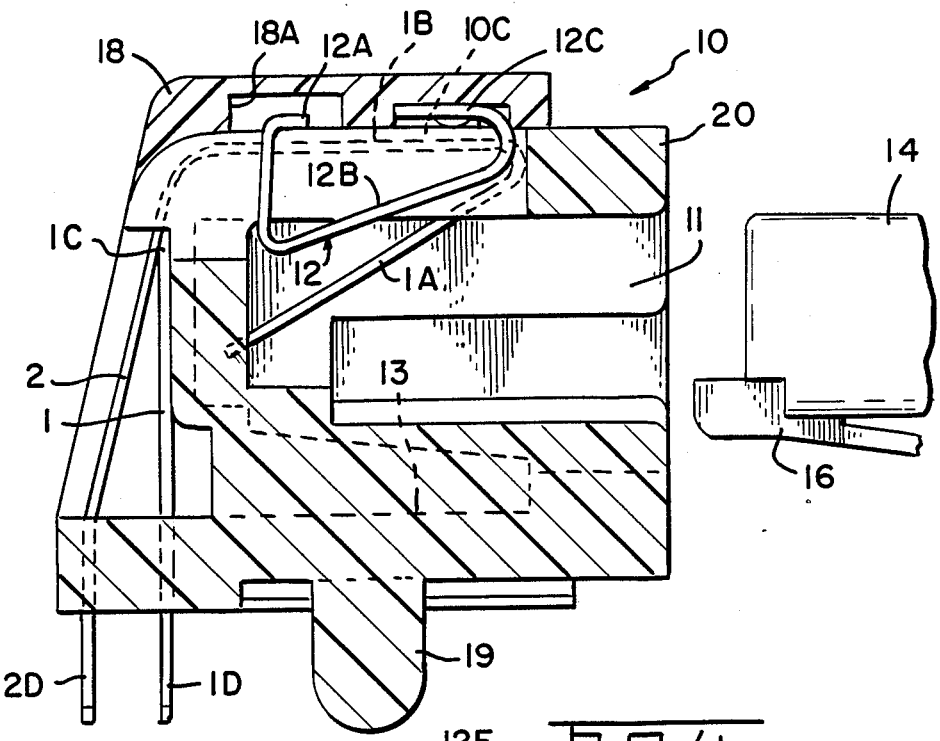
FIG. 4 is a sectional view taken along the lines 4—4 of FIGS. 2 and 3 showing the longitudinal extent of a shunting element.
Figure 5:
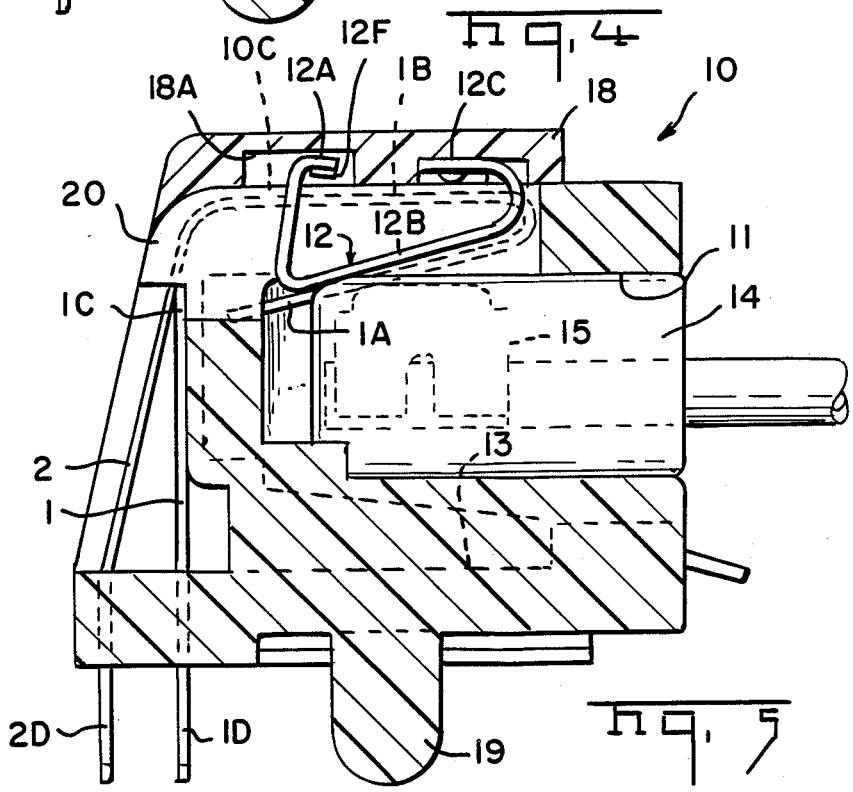
FIG. 5 is a view similar to FIG. 4 but showing the deflection of the shunting element by the insertion of a mating plug into the plug receiving portion of the jack.

As can be seen in FIG. 4 the intermediate section 12B of the shunting element extends longitudinally in much the same manner as the cantilever sections 1A of the contact elements, whereas the laterally extending portions 12A and 12C extend along the laterally side-by-side contact elements 1 thru 8 which form a single row of contact elements. As can be seen in FIG. 5 the intermediate portion of the shunting element 12 is deflectable upon insertion of a mating electrical connector or plug in the cavity 11. Deflection of intermediate portion 12B moves the rear lateral shunt contact portion 12A upwardly out of contact with the upper surface of the outermost contact element. The relatively longitudinally spaced lateral contact element 12C remains fixed since the deflectable intermediate section 12B pivots relative to the front end of the shunting element adjacent the contact portion 12C. Furthermore, an outer cover 18 received on the upper surface of the modular plug 20 and secured thereto engages the upper surface of lateral contact portion 12C to hold that contact portion firmly fixed in a position in engagement with one contact element. Lateral contact element 12C can be secured to outer cover 18. A recess 18A located on the undersurface of the upper cover 18 provides clearance for laterally extending portion 12A to shift upwardly out of engagement of the outermost contact element. Thus the shunting element 12 provides a means of bridging contact between laterally spaced separate contact elements by establishing contact with a stationary or fixed portion of the element rather than by engaging the relatively deflectable portion of the contact elements located within the plug receiving cavity 11.

Figure 9:
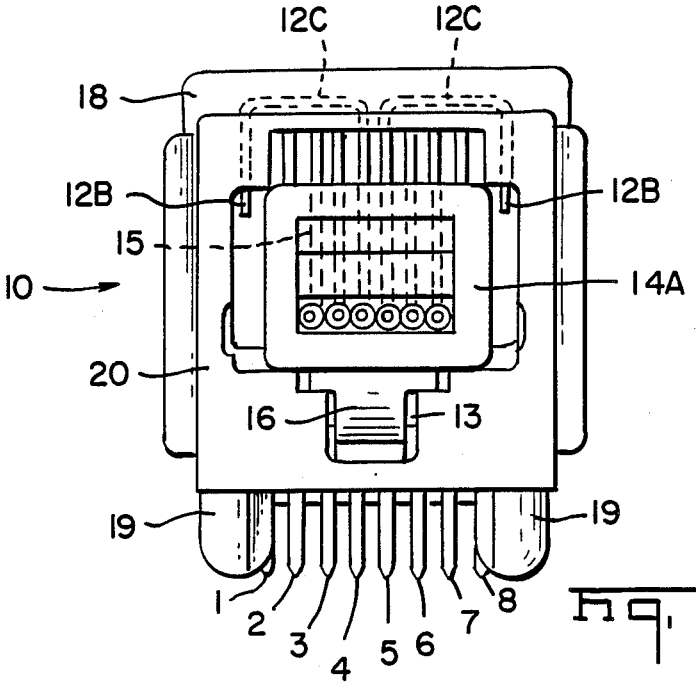
FIG. 9 is a view similar to FIG. 2, but showing a six position plug in mating position.
Figure 10:
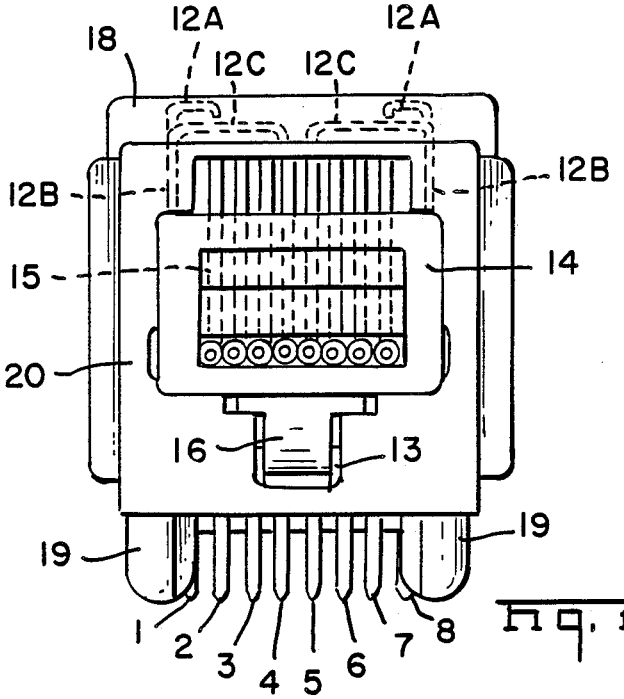
FIG. 10 is a view similar to FIG. 9, but showing an eight position plug in mating position.

In the preferred embodiment of this invention the deflectable intermediate portions 12B extending longitudinally and diagonally in the plug receiving cavity 11 are located adjacent the outermost contact elements. If a plug having a width less than the lateral extent of the contact elements is inserted into plug receiving cavity 11 and keyed by keying profile 13 to be positioned symmetrically relative to the center line of the cavity 11, the plug will now engage the deflectable portions 12B of shunting elements 12 (See FIG. 9). Thus the bridged contact elements will remain shorted. For standard telephone plugs and jacks the width of a six position plug would not be sufficient to engage the deflectable portions of the shunting element. Thus the preferred embodiment positions 1 and 4 would remain bridged while positions 5 and 8 would similarly remain bridged. However an eight position standard plug would have a width greater than the lateral extent of the eight terminals and would deflect the shunting elements, causing lateral shunt contact sections 12A to move out of contact with corresponding contact elements 1 and 8. Thus the present invention, as depicted in the preferred embodiment, provides a means for shunting separate conductors and retaining the bridged contact between conductors when a six position plug having contact terminals in registry with the six innermost contact elements 2 thru 7 is inserted into the plug receiving cavity 11. However, insertion of an eight position plug disrupts the connection between the bridged contacts.

The invention has been disclosed in terms of its preferred embodiment. However, the invention is broader than the specific embodiment depicted herein as the best mode for carrying out the invention. Therefore numerous detail changes could be incorporated without departing from the scope and spirit of the claims as defined herein.

What is claimed is:

1. An electrical connector for use in interconnecting and disconnecting a plurality of separate conductors upon attachment to a mating electrical connector, the first electrical connector comprising:

a housing having a front mating face means including a cavity profiled for receiving the mating electrical connector, a plurality of contact elements, each having first portions extending into the housing cavity and second portions fixed relative to the housing; and at least one shunting element having fixed and moveable contact portions disposed in contact with separate laterally spaced contact element second portions fixed relative to the housing, and an intermediate portion connectable the fixed and movable contact portions, disposed in the housing cavity, movement of the intermediate portion upon insertion of the mating electrical connector into the housing cavity moving the movable contact portion to disrupt the connection between the separate contact elements.

2. An electrical connector for use in interconnecting and disconnecting a plurality of separate conductors upon attachment to a mating electrical connector, the first electrical connector comprising:

a housing having a cavity comprising means for receiving the mating electrical connector;

a plurality of contact elements positioned side by side in a laterally spaced row, each having deflectable portions extending into the cavity;

at least one shunting element having an intermediate portion extending into the cavity, the intermediate portion extending between fixed and moveable contact portions on the shunting element, the fixed and movable contact portions being disposed in contact with separate contact elements, the intermediate portion being deflectable relative to the fixed contact portion by a mating electrical connector inserted into the cavity to disconnect movable contact portion of the contact element.

3. The connector of claim 2 wherein the shunting element contact portions extend laterally relative to the shunting element intermediate portion.

4. The connector of claim 2 wherein the contact elements each comprise integral elements having a first portion extending into the housing cavity and a second portion, the first portion being deflectable relative to the housing upon insertion of a mating electrical connector into the cavity, the second portion remaining stationary relative to the housing upon insertion of a mating electrical connector into the cavity.

5. The connector of claim 4 wherein the shunting element contact portions are disposed in contact with the contact element second portions.

6. The connector of claim 5 wherein the contact element first portions and the shunting element intermediate portion are disposed diagonally in the housing cavity, each being pivotally deflectable upon insertion of a mating electrical connector into the housing cavity.

7. The connector of claim 5 wherein the shunting element contact portions extend laterally relative to the longitudinally extending shunting element intermediate portion, and the shunting element contact portions are relatively longitudinally disposed.

8. A modular jack for use in interconnecting and disconnecting a plurality of separate conductors in equipment connectable to a network through a modular plug attached to the equipment, the modular jack comprising:

a housing having a plug receiving cavity, comprising means for receiving modular plugs of varying width;

a plurality of contact elements positioned in a laterally spaced row, each having deflectable portions extending into the plug receiving cavity;

a keying profile on the housing corresponding to a profiled plug keyed profile, the keying profile comprising means for aligning plugs of varying widths with contact terminals in the modular plug in registry with corresponding contact elements in the modular jack; and at least one integral shunting element having an intermediate portion extending longitudinally into the plug receiving cavity adjacent one longitudinal side thereof, the shunting element having contact portions on opposite ends of the intermediate portions extending laterally thereof, the shunting element contact portions disposed in contact with at least two separate contact elements, the shunting element and the contact elements being resiliently relatively deflectable out of engagement only upon insertion of a modular plug having a width greater than the lateral extent of the row of contact elements.

9. A modular telephone jack for use in interconnecting and disconnecting a plurality of separate conductors in equipment connectable to a switched network through a modular telephone plug attached to the equipment;

the telephone jack comprising;

a housing having a plug receiving cavity, comprising means for receiving modular telephone plugs of varying widths;

a plurality of contact elements positioned side by side in a laterally spaced row, each having resilient cantilever portions extending into the plug receiving cavity, each contract element being connectable to a conductor in the switched network at a location spaced from the cantilever portions;

a keying profile on the housing corresponding to a mating keyed profile on the plug, the keying profile comprising means for aligning contact terminals on plugs of varying widths inserted into the plug receiving cavity with corresponding contact element cantilever portions of the plug receiving cavity; and at least one shunting element having an intermediate portion, extending into the plug receiving cavity and contacting portions at opposite ends, the ends of the shunting element being disposable in contact with at least two separate contact elements, the intermediate portions of the shunting element being disposed laterally outwardly of an outermost contact element cantilever portion, the shunting element ends extending laterally of the contact elements, the shunting element and the contact elements being resiliently relatively deflectable out of engagement only upon insertion of the telephone plug having a width greater than the lateral extend of the row of contact elements.

10. The modular telephone jack of claim 9 wherein each contact element connectable to a conductor in the switched network comprises an integral element having a lead portion on one end opposite from the cantilever portion, the lead portions extending externally of the housing and being disposed for interconnection to discrete paths on a printed circuit board.

11. THe modular telephone jack of claim 9 wherein the shunting element ends are disposed in contact with outer surfaces of separate contact elements, at least one shunting element end being deflectable outwardly only upon insertion of a telephone plug having a width greater than the lateral extent of the row of contact elements to disconnect the two bridged contact elements.

12. The modular telephone jack of claim 9 comprising an eight position member having eight separate contact elements in side-by-side, first through eighth positions, and two shunting elements, the first shunting element bridging the contact elements in the first and fourth positions to a ring conductor of a switched telephone network and the second element shorting the contact elements in the fifth and eighth positions to a tip conductor in a switched telephone network, the ring conductor and tip conductor remaining bridged through the modular telephone jack by the shunting elements upon insertion of a telephone plug having six contact terminals and a width no greater than the lateral extent of the eight side-by-side contact elements, the shunting elements being deflected to disengage the serial connection of the ring and tip conductor through the modular telephone jack upon insertion of a telephone plug having eight contact terminals and a width greater than the lateral extent of the eight side-by-side contact elements.

* * * * *